US011362432B2

(12) United States Patent
Perkins et al.

(10) Patent No.: US 11,362,432 B2
(45) Date of Patent: Jun. 14, 2022

(54) DIFFERENTIAL SEGMENTED APERTURE

(71) Applicant: Battelle Memorial Institute, Columbus, OH (US)

(72) Inventors: Daniel A. Perkins, Lewis Center, OH (US); Daniel G. Loesch, Sunbury, OH (US); Donald C. Discher, Hilliard, OH (US); Raphael Joseph Welsh, Powell, OH (US)

(73) Assignee: Battelle Memorial Institute, Columbus, OH (US)

( * ) Notice: Subject to any disclaimer, the term of this patent is extended or adjusted under 35 U.S.C. 154(b) by 122 days.

(21) Appl. No.: 16/857,713

(22) Filed: Apr. 24, 2020

(65) Prior Publication Data

US 2020/0343645 A1 Oct. 29, 2020

Related U.S. Application Data

(60) Provisional application No. 62/839,121, filed on Apr. 26, 2019.

(51) Int. Cl.
*H01Q 17/00* (2006.01)
*H01P 5/10* (2006.01)
(Continued)

(52) U.S. Cl.
CPC ..... *H01Q 17/008* (2013.01); *H01P 5/10* (2013.01); *H01Q 21/061* (2013.01); *H01Q 23/00* (2013.01)

(58) Field of Classification Search
CPC .... H01Q 17/008; H01Q 21/061; H01Q 21/22; H01Q 21/06; H01Q 21/067; H01Q 23/00;
(Continued)

(56) References Cited

U.S. PATENT DOCUMENTS 7,420,522 B1 * 9/2008 Steinbrecher ..... H01Q 17/008 343/893
10,056,699 B2 8/2018 Elsallal
(Continued)

FOREIGN PATENT DOCUMENTS

EP 2727183 A2 5/2014
WO WO 2017/086855 A1 5/2017

OTHER PUBLICATIONS

Partial International Search Report for PCT Application No. PCT/US2020/029696 dated Jun. 23, 2020.

*Primary Examiner* — Seokjin Kim
(74) *Attorney, Agent, or Firm* — Fay Sharpe LLP

(57) ABSTRACT

A radio frequency (RF) aperture includes an interface printed circuit board. An array of electrically conductive tapered projections have bases disposed on a front side of the interface printed circuit board and extend away from the front side of the interface printed circuit board. Chip baluns are mounted on the back side of the interface printed circuit board. Each chip balun has a balanced port electrically connected with two neighboring electrically conductive tapered projections via electrical feedthroughs passing through the interface printed circuit board. Each chip balun further has an unbalanced port, and RF circuitry disposed at the back side of the interface printed circuit board is electrically connected with the unbalanced ports of the chip baluns. The electrically conductive tapered projections include dielectric tapered projections and an electrically conductive layer disposed on an inner or outer surface of the dielectric tapered projections.

21 Claims, 10 Drawing Sheets

(51) Int. Cl.
*H01Q 21/06* (2006.01)
*H01Q 23/00* (2006.01)

(58) Field of Classification Search
CPC . H01Q 9/28; H01Q 1/36; H01Q 1/523; H01P 5/10
See application file for complete search history.

(56) References Cited

U.S. PATENT DOCUMENTS

| | | | | |
|---|---|---|---|---|
| 10,145,660 | B1 | 12/2018 | Fluhler et al. | |
| 10,340,606 | B2 | 7/2019 | Elsallal | |
| 2006/0038732 | A1* | 2/2006 | DeLuca | H01Q 21/064 343/754 |
| 2011/0221649 | A1* | 9/2011 | Price | H01P 11/003 333/238 |
| 2020/0177151 | A1* | 6/2020 | Pierce | H01F 27/2804 |

* cited by examiner

Control Modes:

1. All Ns and Ms are in transmit mode
2. All Ns and Ms are in receive mode
3. All Ns are in transmit mode and all Ms are in receive mode
4. All Ns are in receive mode and all Ms are in transmit mode

DIFFERENTIAL SEGMENTED APERTURE

This application claims the benefit of U.S. Provisional Application No. 62/839,121 filed Apr. 26, 2019 and titled "DIFFERENTIAL SEGMENTED APERTURE". U.S. Provisional Application No. 62/839,121 filed Apr. 26, 2019 is incorporated herein by reference in its entirety.

BACKGROUND

The following relates to the radio frequency (RF) arts, RF transmitter arts, RF receiver arts, RF transceiver arts, broadband RF transmitter, receiver, and/or transceiver arts, RF communications arts, and related arts.

Steinbrecher, U.S. Pat. No. 7,420,522 titled "Electromagnetic Radiation Interface System and Method" discloses a broadband RF aperture as follows: "An electromagnetic radiation interface is provided that is suitable for use with radio wave frequencies. A surface is provided with a plurality of metallic conical bristles. A corresponding plurality of termination sections are provided so that each bristle is terminated with a termination section. The termination section may comprise an electrical resistance for capturing substantially all the electromagnetic wave energy received by each respective bristle to thereby prevent reflections from the surface of the interface. Each termination section may also comprise an analog to digital converter for converting the energy from each bristle to a digital word. The bristles may be mounted on a ground plane having a plurality of holes therethrough. A plurality of coaxial transmission lines may extend through the ground plane for interconnecting the plurality of bristles to the plurality of termination sections."

Certain improvements are disclosed herein.

BRIEF SUMMARY

In accordance with some illustrative embodiments a radio frequency (RF) aperture is disclosed. An interface printed circuit board has a front side and a back side. An array of electrically conductive tapered projections have bases disposed on the front side of the interface printed circuit board and extend away from the front side of the interface printed circuit board. Chip baluns are mounted on the back side of the interface printed circuit board. Each chip balun has a balanced port electrically connected with two neighboring electrically conductive tapered projections of the array of electrically conductive tapered projections via electrical feedthroughs passing through the interface printed circuit board. Each chip balun further has an unbalanced port. RF circuitry is disposed at the back side of the interface printed circuit board and is electrically connected with the unbalanced ports of the chip baluns.

In accordance with some illustrative embodiments disclosed herein, a method of manufacturing a radio frequency (RF) aperture comprises: coating a surface of dielectric tapered projections with an electrically conductive layer to form electrically conductive tapered projections; mounting the electrically conductive tapered projections on a front side of an interface printed circuit board; mounting RF circuitry on the interface printed circuit board and/or on a second printed circuit board mounted parallel with the interface printed circuit board; and electrically connecting the RF circuitry with the electrically conductive tapered projections.

In accordance with some illustrative embodiments disclosed herein, an RF aperture comprises: an interface printed circuit board having a front side and a back side; an array of electrically conductive tapered projections; and RF circuitry. The electrically conductive tapered projections have bases disposed on the front side of the interface printed circuit board and extending away from the front side of the interface printed circuit board. The electrically conductive tapered projections comprise dielectric tapered projections and an electrically conductive layer disposed on a surface of the dielectric tapered projections. The RF circuitry is disposed at the back side of the interface printed circuit board and is electrically connected with the array of electrically conductive tapered projections via electrical feedthroughs passing through the interface printed circuit board. In some embodiments, the RF circuitry further includes baluns with balanced ports connecting pairs of electrically conductive tapered projections that are adjacent in the array of electrically conductive tapered projections via the electrical feedthroughs passing through the interface printed circuit board.

BRIEF DESCRIPTION OF THE DRAWINGS

Any quantitative dimensions shown in the drawing are to be understood as non-limiting illustrative examples. Unless otherwise indicated, the drawings are not to scale; if any aspect of the drawings is indicated as being to scale, the illustrated scale is to be understood as non-limiting illustrative example.

DETAILED DESCRIPTION

Figure 1:
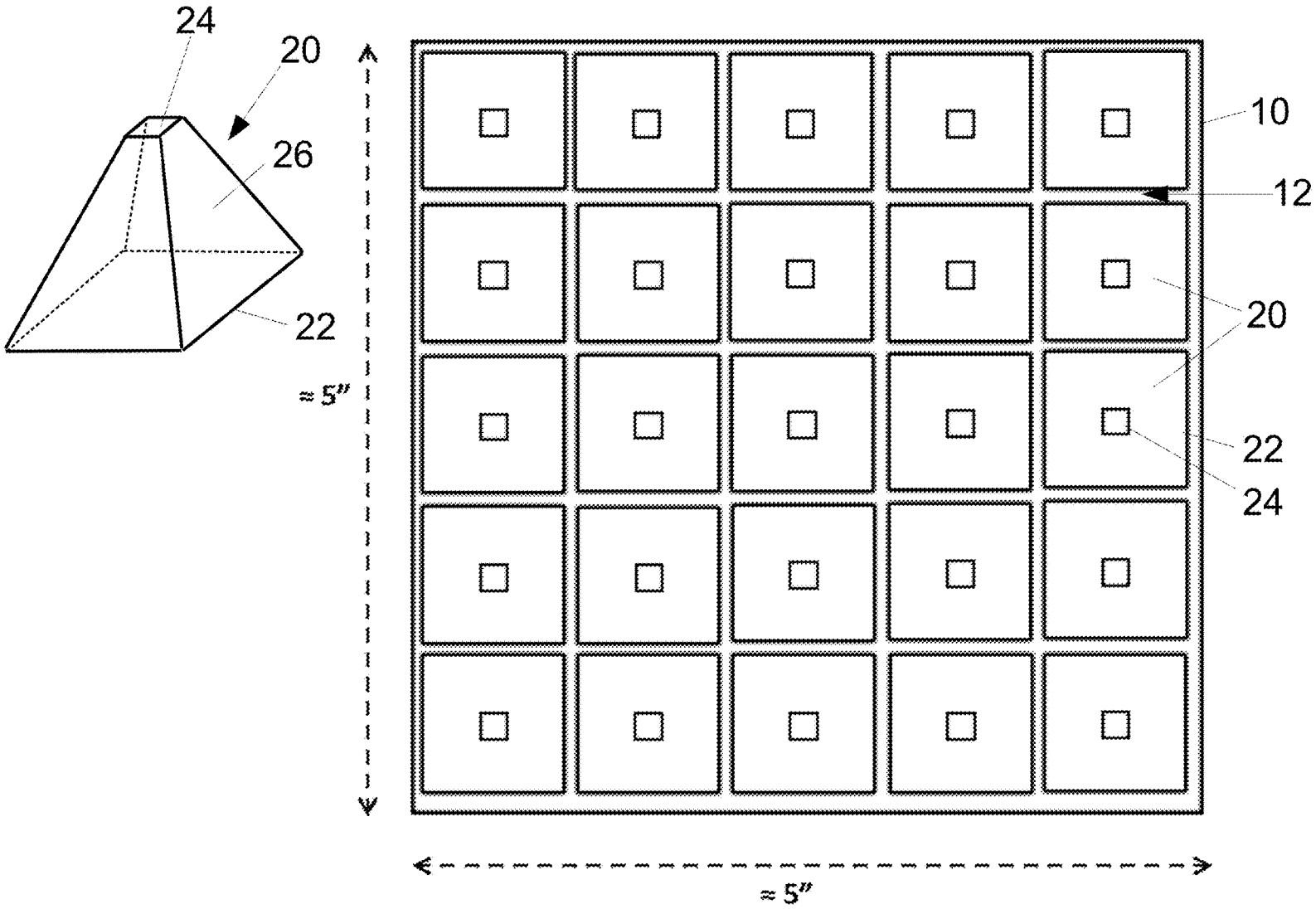
FIGS. 1 and 2 diagrammatically illustrate front and side-sectional views, respectively, of an illustrative differential segmented aperture (DSA).
Figure 2:
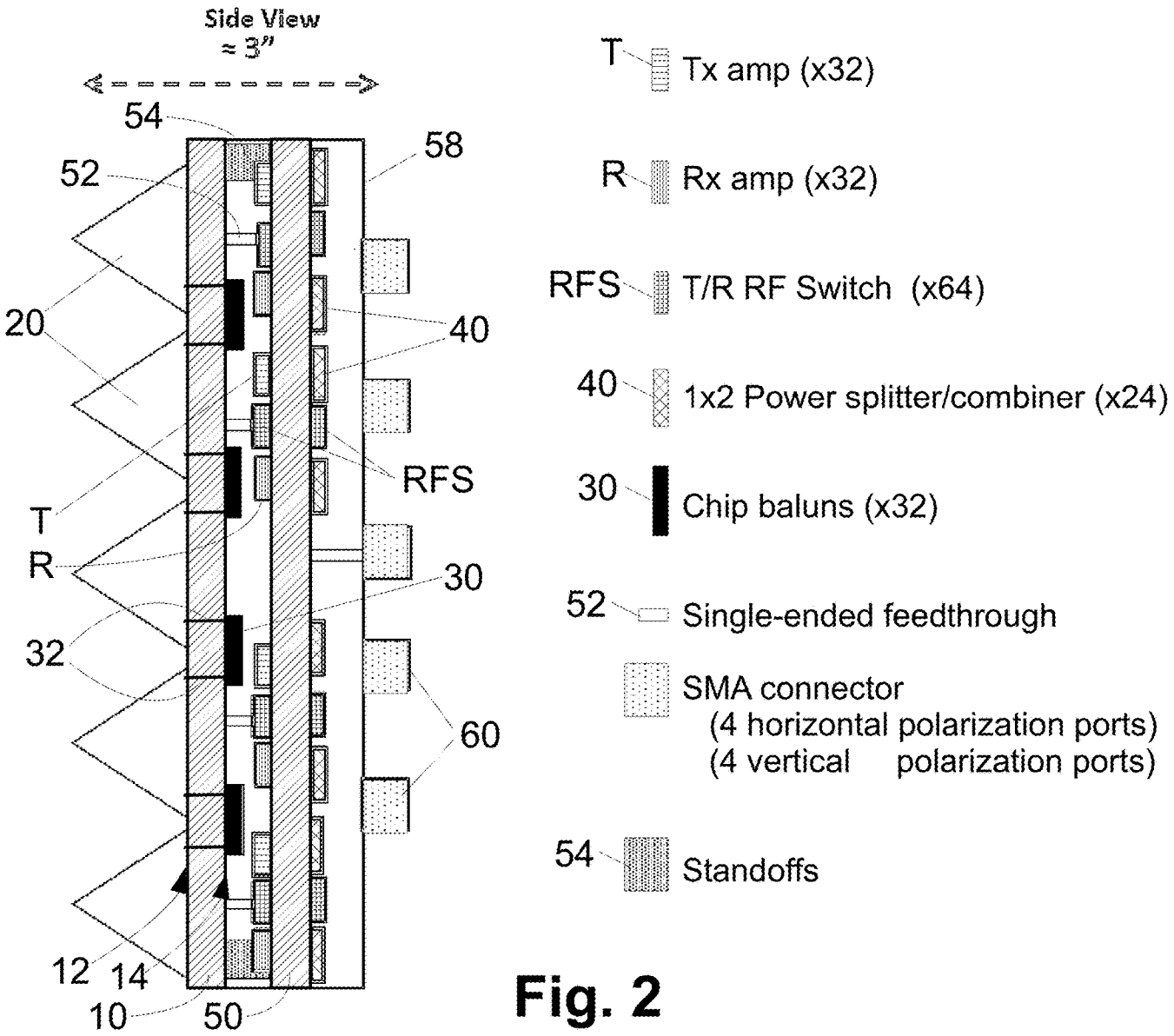

With reference to FIGS. 1 and 2, front and side-sectional views are shown, respectively, of an illustrative radio frequency (RF) aperture, including an interface printed circuit board (i-PCB) 10 having a front side 12 and a back side 14, and an array of electrically conductive tapered projections 20 having bases 22 disposed on the front side 12 of the i-PCB 10 and extending away from the front side 12 of the i-PCB 10. The illustrative i-PCB 10 is indicated in FIG. 1 as having dimensions 5-inch by 5-inch—this is merely a non-limiting illustrative example of a compact RF aperture. FIG. 1 shows the front view of the RF aperture, with an inset in the upper left showing a perspective view of one electrically conductive tapered projection 20. This illustrative embodiment of the electrically conductive tapered projection 20 has a square cross-section with a larger square base 22 and an apex which does not extend to a perfect tip but rather terminates at a flattened apex 24 (in other words, the electrically conductive tapered projection 20 of the inset has a frustoconical shape). This is merely an illustrative example, and more generally the electrically conductive tapered projections 20 can have any type of cross-section (e.g. square as in the inset, or circular, or hexagonal, or octagonal, or so forth). The apex 24 can be flat, as in the example of the inset, or can come to a sharp point, or can be rounded or have some other apex geometry. The rate of tapering as a function of height (i.e. distance "above" the base 22, with the apex 24 being at the maximum "height") can be constant, as in the example of the inset, or the rate of tapering can be variable with height, e.g. the rate of tapering can increase with increasing height so as to form a projection with a rounded peak, or can be decreasing with increasing height so as to form a projection with a more pointed tip. Similarly, as best seen in FIG. 1, the illustrative array of the electrically conductive tapered projections 20 is a rectilinear array with regular rows and orthogonal regular columns; however, the array may have other symmetry, e.g. a hexagonal symmetry, octagonal symmetry, or so forth. In the illustrative example of the inset, the square base 22 and square apex 24 lead to the electrically conductive tapered projection 20 having four flat slanted sidewalls 26; however, other sidewall shapes are contemplated, e.g. if the base and apex are circular (or the base is circular and the apex comes to a point) then the sidewall will be a slanted or tapering cylinder; for a hexagonal base and a hexagonal or pointed apex there will be six slanted sidewalls, and so forth.

Figure 3:
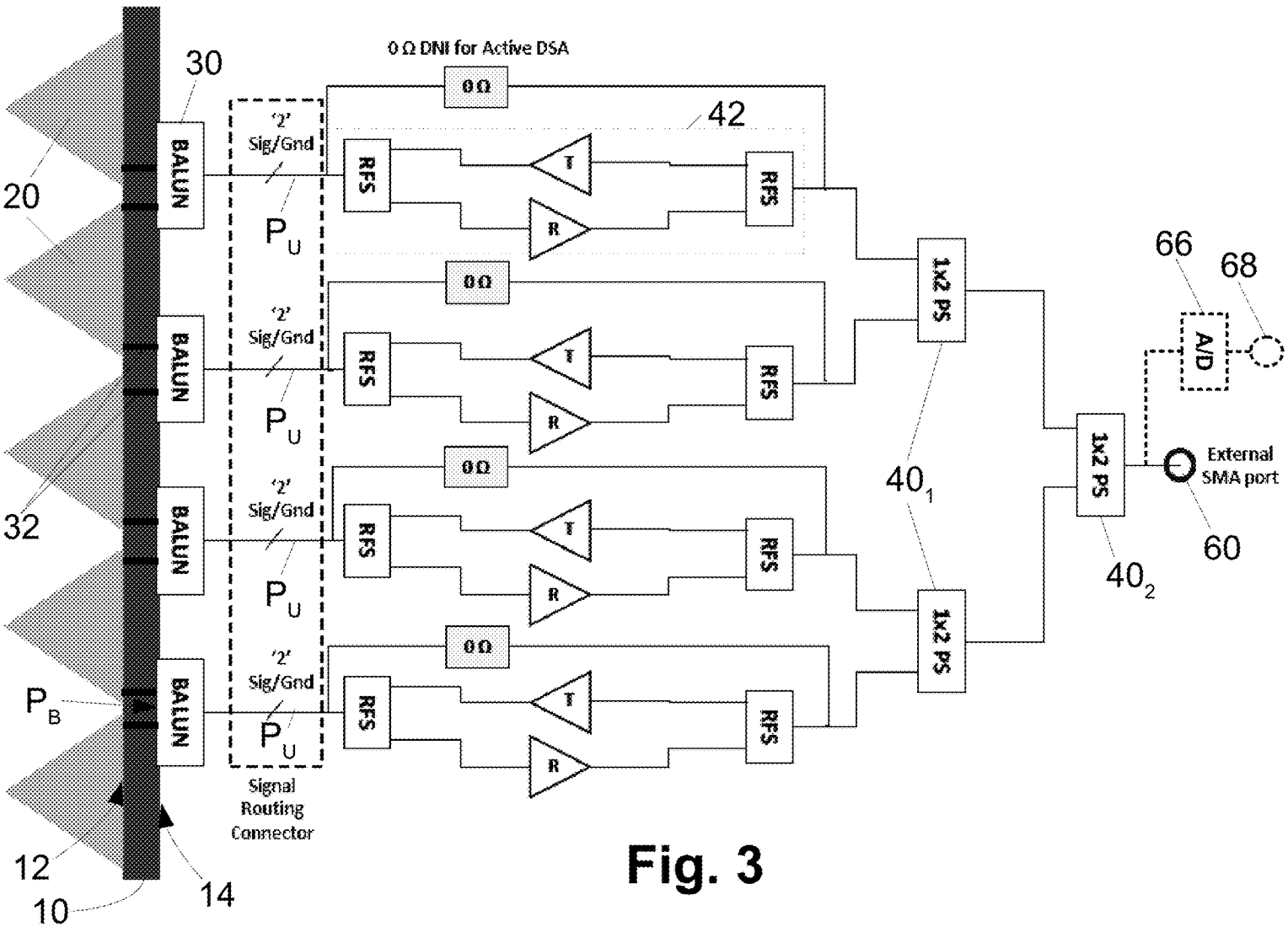
FIG. 3 diagrammatically shows a block diagram of a single QUAD subassembly of the DSA of FIGS. 1-4.

With continuing reference to FIGS. 1 and 2 and with further reference to FIG. 3, the RF aperture further comprises RF circuitry, which in the illustrative embodiment includes chip baluns 30 mounted on the back side 14 of the i-PCB 10. Each chip balun 30 has a balanced port $P_B$ (see FIGS. 3 and 6) electrically connected with two neighboring electrically conductive tapered projections of the array of electrically conductive tapered projections via electrical feedthroughs 32 passing through the i-PCB 10. Each chip balun 30 further has an unbalanced port $P_U$ (see FIGS. 3 and 6) connecting with the remainder of the RF circuitry. The illustrative RF circuitry further includes RF power splitter/combiners 40 for combining the outputs from the unbalanced ports $P_U$ of the chip baluns 30. As seen in FIG. 3, the illustrative electrical configuration of the RF circuitry employs first level 1×2 RF power splitter/combiners $\mathbf{40}_1$ that combine pairs of unbalanced ports $P_U$, and second level 1×2 RF power splitter/combiners $\mathbf{40}_2$ that combine outputs of pairs of the first level RF power splitter/combiners $\mathbf{40}_1$. This is merely an illustrative approach, and other configurations are contemplated, such as using 1×3 (which combine three lines), 1×4 (combining four lines), or higher-combining RF power splitter/combiners, or various combinations thereof. The illustrative RF circuitry further includes a signal conditioning circuit 42 interposed between each unbalanced port $P_U$ of the chip baluns 30 and the first level 1×2 power splitter $\mathbf{40}_1$. The signal conditioning circuit 42 connected with each unbalanced port includes: an RF transmit amplifier T; an RF receive amplifier R; and RF switching circuitry including switches RFS configured to switch between a transmit mode operatively connecting the RF transmit amplifier T with the unbalanced port and a receive mode operatively connecting the RF receive amplifier R with the unbalanced port.

Figure 4:
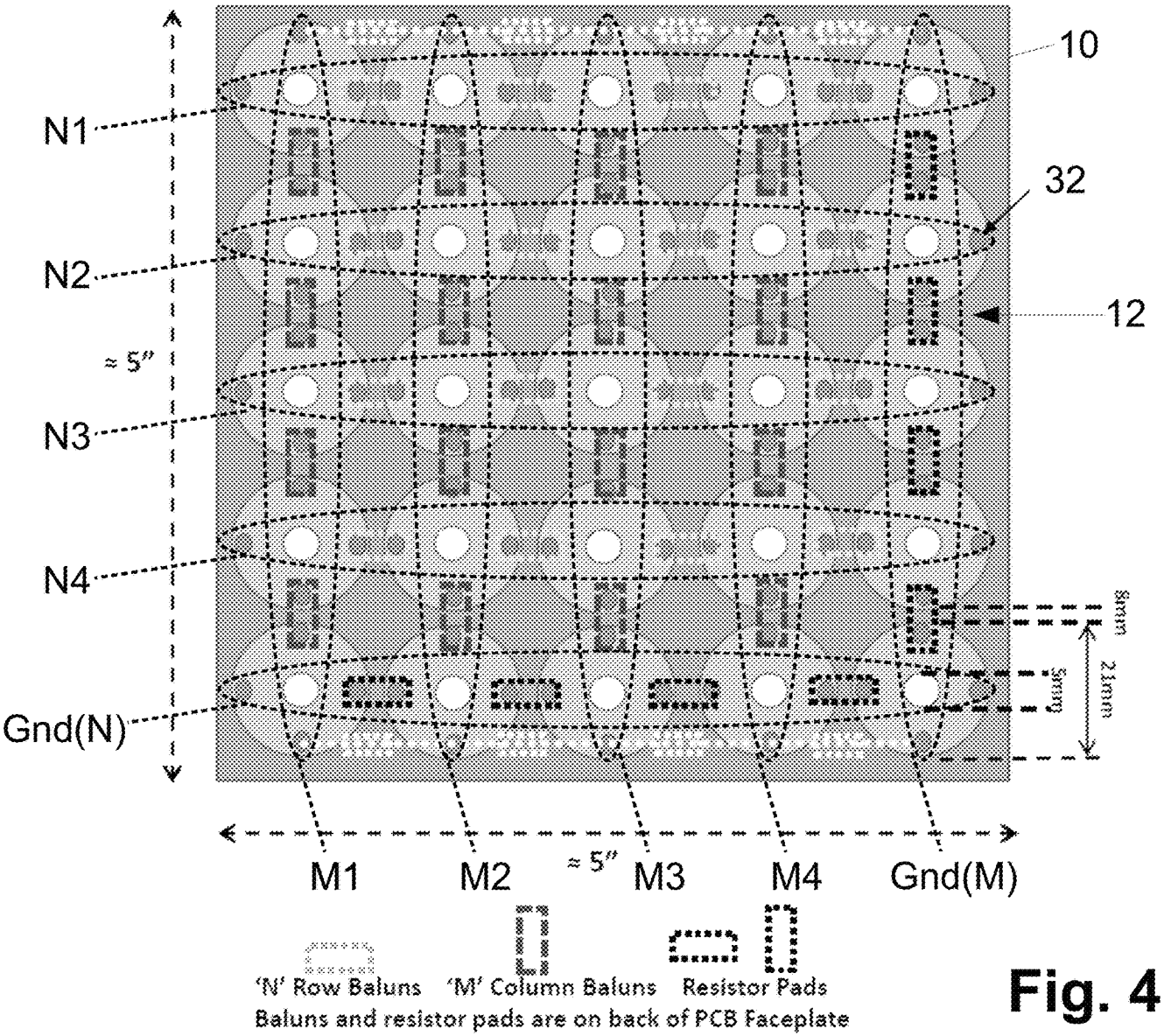
FIG. 4 diagrammatically illustrates a front view of the interface printed circuit board (i-PCB) of the DSA of FIGS. 1-3 including vias and mounting holes and diagrammatically indicated locations of baluns and resistor pads.
Figure 5:
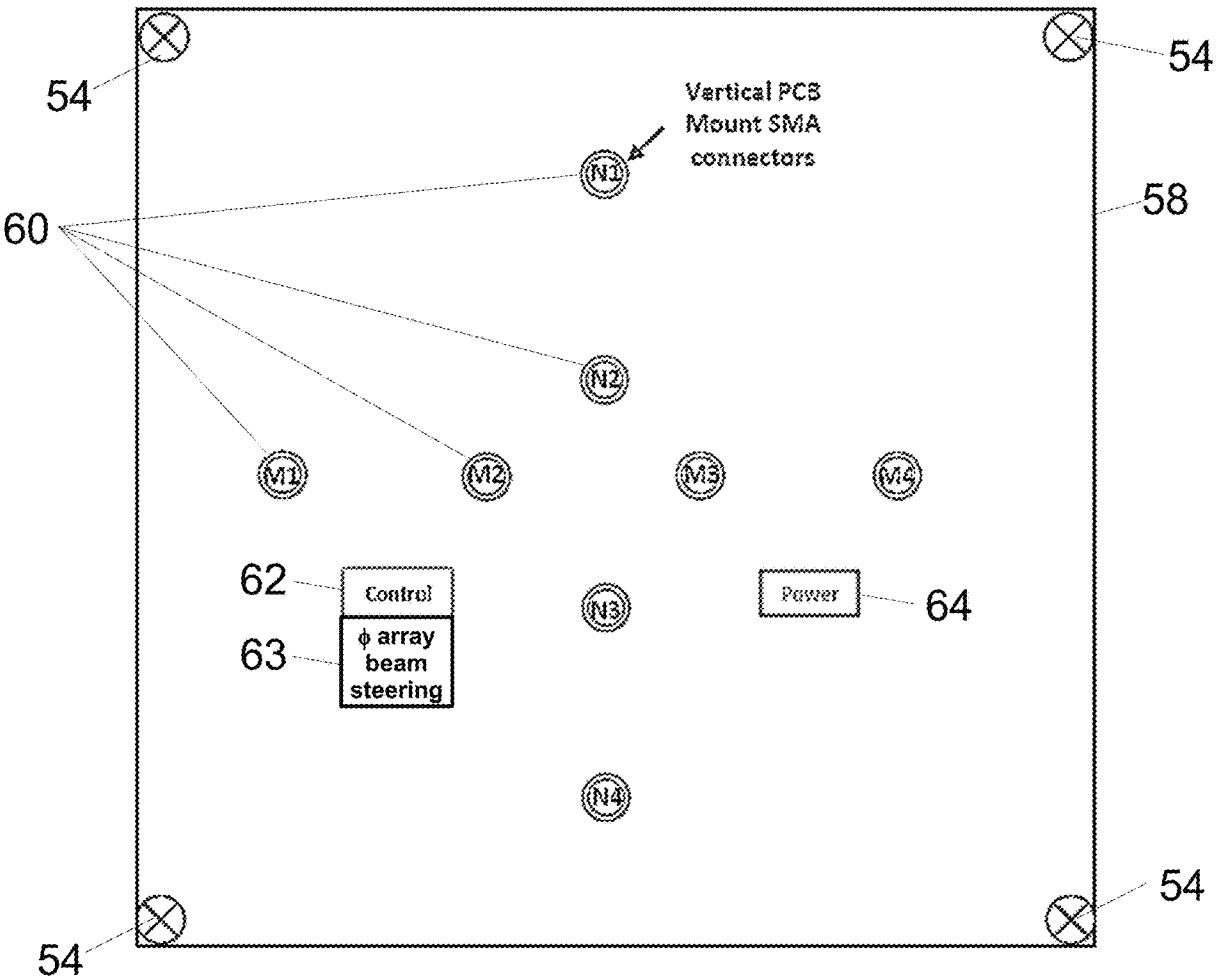
FIG. 5 diagrammatically illustrates a rear view of the enclosure of the DSA of FIGS. 1-4 including diagrammatically indicated RF connections, control, and power connectors.

With continuing reference to FIGS. 1-3 and with further reference to FIGS. 4 and 5, a compact design is achieved (e.g., depth of 3-inches in the non-limiting illustrative example of FIG. 3) in part by employing one or more printed circuit boards (PCBs) including at least the i-PCB 10. In the illustrative example shown in FIG. 3, the chip baluns 30 are mounted on the back side 14 of the i-PCB 10. Optionally, the other electronic components may also be mounted on the back side of the i-PCB 10 on whose front side 12 the array of electrically conductive tapered projections 20 are disposed. However, there may be insufficient real estate on the i-PCB 10 to mount all the electronics of the RF circuitry. In the illustrative embodiment, this is handled by providing a second printed circuit board 50 which is disposed parallel with the i-PCB 10 and faces the back side 14 of the i-PCB 10. Said another way, the second printed circuit board 50 is disposed on the (back) side 14 of the i-PCB 10 opposite from the (front) side 12 of the i-PCB 10 on which the electrically conductive tapered projections 20 are disposed. The RF circuitry comprises electronic components mounted on the second printed circuit board 50, which may also be referred to herein as a signal conditioning PCB or SC-PCB 50, and additionally or alternatively comprises electronic components mounted on the i-PCB 10 (typically on the back side 14 of the i-PCB, although it is also contemplated (not shown) to mount components of the RF circuitry on the front side of the i-PCB in field space between the electrically conductive tapered projections 20. If the SC-PCB 50 is provided, as shown in FIG. 2 it is suitably secured in parallel with the i-PCB 10 by standoffs 54, and single-ended feedthroughs 52 are provided to electrically interconnect the i-PCB 10 and the SC-PCB 50 (see FIG. 3). If the RF circuitry is unable to fit onto the real estate of two PCBs 10, 50, a third (and fourth, and more, as needed) PCB may be added (not shown) to accommodate the components of the RF circuitry.

FIG. 4 shows a front view of the i-PCB 10 including vias and mounting holes and diagrammatically indicated locations of baluns 30 and resistor pads as indicated in the legend shown in FIG. 4. (The resistors are used to terminate the unused side of the pyramids to help lower radar cross section).

With reference to FIG. 2 and with further reference to FIG. 5, the illustrative RF aperture has an enclosure 58 which in the illustrative example is secured at its periphery with the periphery of the i-PCB 10 so as to enclose the RF circuitry. This is merely one illustrative arrangement, and other designs are contemplated, e.g. both PCBs 10, 50 may be disposed inside an enclosure (although such an enclosure should not comprise RF shielding extending forward so as to occlude the area of the RF aperture). FIG. 5 diagrammatically illustrates a rear view of the enclosure 58 of the RF aperture, showing diagrammatically indicated RF connectors (or ports) 60 (also shown or indicated in FIGS. 2 and 3), control electronics 62 (for example, illustrative phased array beam steering electronics 63 shown by way of non-limiting illustration; these electronics 62, 63 may be mounted on the exterior of the enclosure 58 and/or may be disposed inside the enclosure 58 providing beneficial RF shielding), and a power connector 64 for providing power for operating the active components of the RF circuitry (e.g. operating power for the active RF transmit amplifiers T and the active RF receive amplifiers R, and the switches RFS). The particular arrangement of the various components 60, 62, 63, 64 over the area of the back side of the enclosure can vary widely from that shown in FIG. 5, and moreover, these components may be located elsewhere, e.g. the RF connectors 60 could alternatively be located at an edge of the RF aperture or so forth. It will also be appreciated that the RF aperture could be constructed integrally with some other component or system—for example, if the RF aperture is used as the RF transmit and/or receive element of a mobile ground station, a maritime radio, an unmanned aerial vehicle (UAV), or so forth, in which case the enclosure 58 might be replaced by having the RF aperture built into a housing of the mobile ground station, maritime radio, UAV fuselage, or so forth. In such cases, the RF connectors 60 might also be replaced by hard-wired connections to the mobile ground station, maritime radio, UAV electronics, or so forth.

With particular reference to FIG. 3, an illustrative electrical configuration for the illustrative RF circuitry is shown. In this non-limiting illustrative example, the array of electrically conductive tapered projections 20 is assumed to be a 5×5 array of electrically conductive tapered projections 20, as shown in FIGS. 1 and 4. The balanced ports $P_B$ of the chip baluns 30 connect adjacent (i.e. neighboring) pairs of electrically conductive tapered projections 20 of the array so as to receive the differential RF signal between the two adjacent electrically conductive tapered projections 20 (in receive mode; or, alternatively, to apply a differential RF signal between the two adjacent electrically conductive tapered projections 20 in transmit mode). As detailed in Steinbrecher, U.S. Pat. No. 7,420,522 which is incorporated herein by reference in its entirety, the tapering of the electrically conductive tapered projections 20 presents a separation between the two electrically conductive tapered projections 20 that varies with the "height", i.e. with distance "above" the base 22 of the electrically conductive tapered projections 20. This provides broadband RF capture since a range of RF wavelengths can be captured corresponding to the range of separations between the adjacent electrically conductive tapered projections 20 introduced by the tapering. The RF aperture is thus a differential segmented aperture (DSA), and has differential RF receive (or RF transmit) elements corresponding to the adjacent pairs of electrically conductive tapered projections 20. These differential RF receive (or transmit) elements are referred to herein as aperture pixels. For the illustrative rectilinear 5×5 array of adjacent electrically conductive tapered projections 20, this means there are 4 aperture pixels along each row (or column) of 5 electrically conductive tapered projections 20. More generally, for a rectilinear array of projections having a row (or column) of N electrically conductive tapered projections 20, there will be a corresponding N−1 pixels along the row (or column). FIG. 3 shows a QUAD subassembly, which is an interconnection of a row (or column) of four pixels. As there are four rows, and four columns, this leads to 4×4 or 16 such QUAD subassemblies. The resistor pads are used as terminations for the unused edges of the perimeter pyramids to prevent unnecessary reflections. Without the resistors mounted via the resistor pads, those surfaces would be left floating and could re-radiate incident RF energy, causing an enhanced radar cross section.

In the illustrative embodiment shown in FIG. 3, the second level 1×2 RF power splitter/combiner $\mathbf{40}_2$ of each QUAD subassembly connects with an RF connector 60 at the backside of the enclosure 58. Hence, as seen in FIG. 5, there are eight RF connectors for the eight QUAD subassemblies, denoted in FIGS. 4 and 5 as the row QUAD subassemblies N1, N2, N3, N4 and the column QUAD subassemblies M1, M2, M3, M4. The Gnd(N) row and the Gnd(M) column are circuit grounds to allow a common path for current flow from the captured RF energy along the perimeter sides of the pyramids. The use of the QUAD subassemblies permits a high level of flexibility in RF coupling to the RF aperture. For example, the illustrative phased array beam steering electronics 63 may be implemented by introducing appropriate phase shifts $\phi_N$, N=1, . . . , 4 for the row QUAD subassemblies N1, N2, N3, N4 and phase shifts $\phi_M$, M=1, . . . , 4 for the column QUAD subassemblies M1, M2, M3, M4 to steer the transmitted RF signal beam in a desired direction, or to orient the RF aperture to receive an RF signal beam from a desired direction (transmit or receive being controlled by the settings of the switches RFS of the signal conditioning circuits 42). Other applications that may be implemented by the RF aperture include: simultaneous "Transmit/Receive, dual circular polarization modes", and "Scalability" by physically locating multiple DSAs in close physical proximity giving the combined effect of increased aperture size. In an alternative embodiment diagrammatically shown in FIG. 3, the RF connectors 60 may be replaced by analog-to-digital (A/D) converters 66 and digital connectors 68 via which digitized signals are output. More generally, the A/D conversion may be inserted anywhere in the RF chain, for example A/D converters could be placed at the outputs of the signal conditioning circuits 42 and the analog first and second level RF power splitter/combiners $\mathbf{40}_1$, $\mathbf{40}_2$ then replaced by digital signal processing (DSP) circuitry.

The described electronics employing PCBs 10, 50, chip baluns 30, and active signal conditioning components (e.g. active transmit amplifiers T and receive amplifiers R) advantageously enables the RF aperture to be made compact and lightweight. As described next, embodiments of the electrically conductive tapered projections 20 further facilitate providing a compact and lightweight broadband RF aperture.

Figure 6:
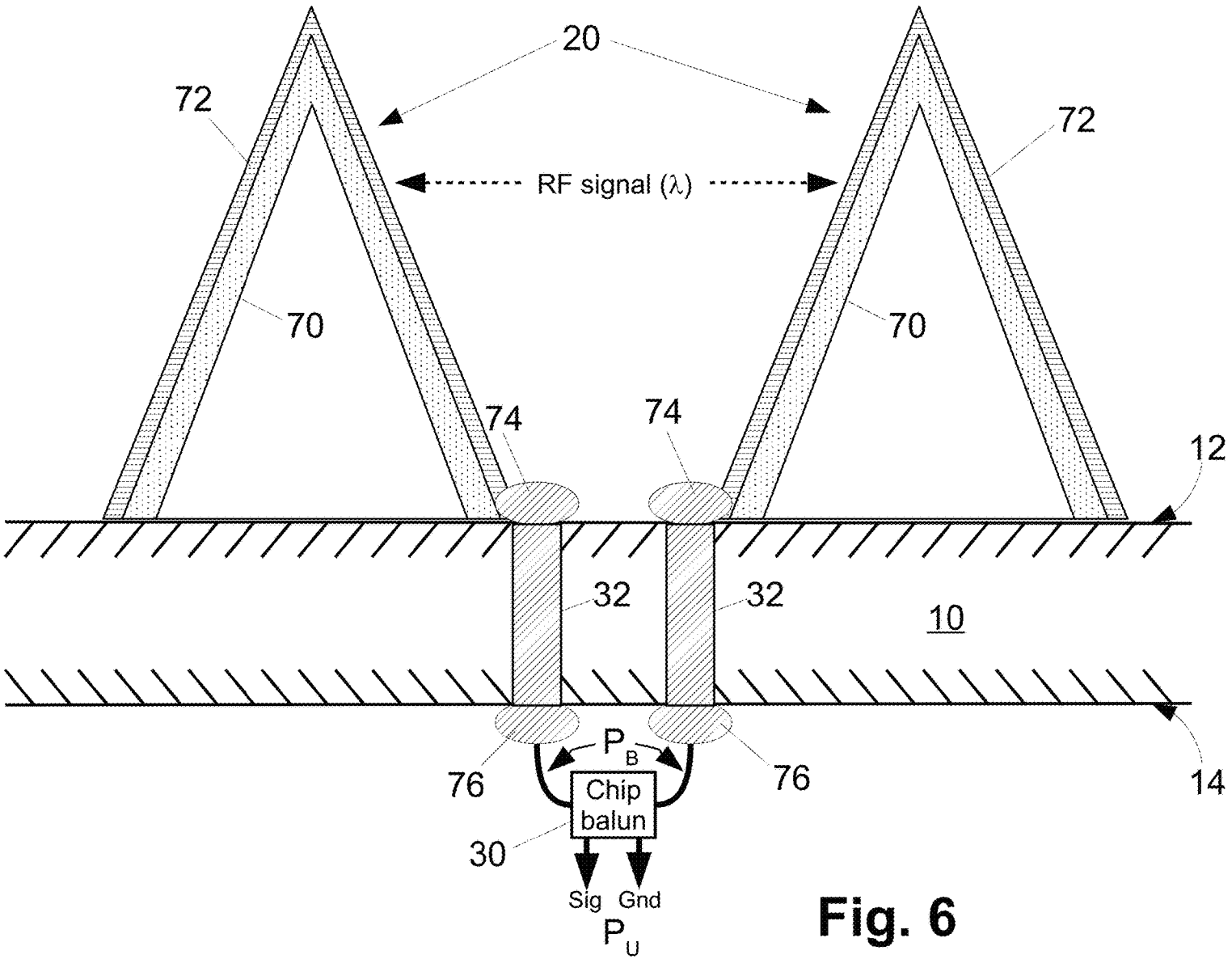
FIG. 6 diagrammatically illustrates a side sectional view of an embodiment of the electrically conductive tapered projections, along with a diagrammatic representation of the connection of the balanced port of a chip balun between two adjacent electrically conductive tapered projections.

FIG. 6 shows a side sectional view of one illustrative embodiment in which each electrically conductive tapered projection 20 is fabricated as a dielectric tapered projection 70 with an electrically conductive layer 72 disposed on a surface of the dielectric tapered projection 70. The dielectric tapered projections may, for example, be made of an electrically insulating plastic or ceramic material, such as acrylonitrile butadiene styrene (ABS), polycarbonate, or so forth, and may be manufactured by injection molding, three-dimensional (3D) printing, or other suitable techniques. The electrically conductive layer 72 may be any suitable electrically conductive material such as copper, a copper alloy, silver, a silver alloy, gold, a gold alloy, aluminum, an aluminum alloy, or so forth, or may include a layered stack of different electrically conductive materials, and may be coated onto the dielectric tapered projection 70 by vacuum evaporation, RF sputtering, or any other vacuum deposition technique. FIG. 6 shows an example in which solder points 74 are used to electrically connect the electrically conductive layer 72 of each dielectric tapered projection 20 with its corresponding electrical feedthrough 32 passing through the i-PCB 10. FIG. 6 also shows the illustrative connection of the balanced port PB of one chip balun 30 between two adjacent electrically conductive tapered projections 20 via solder points 76.

Figure 7:
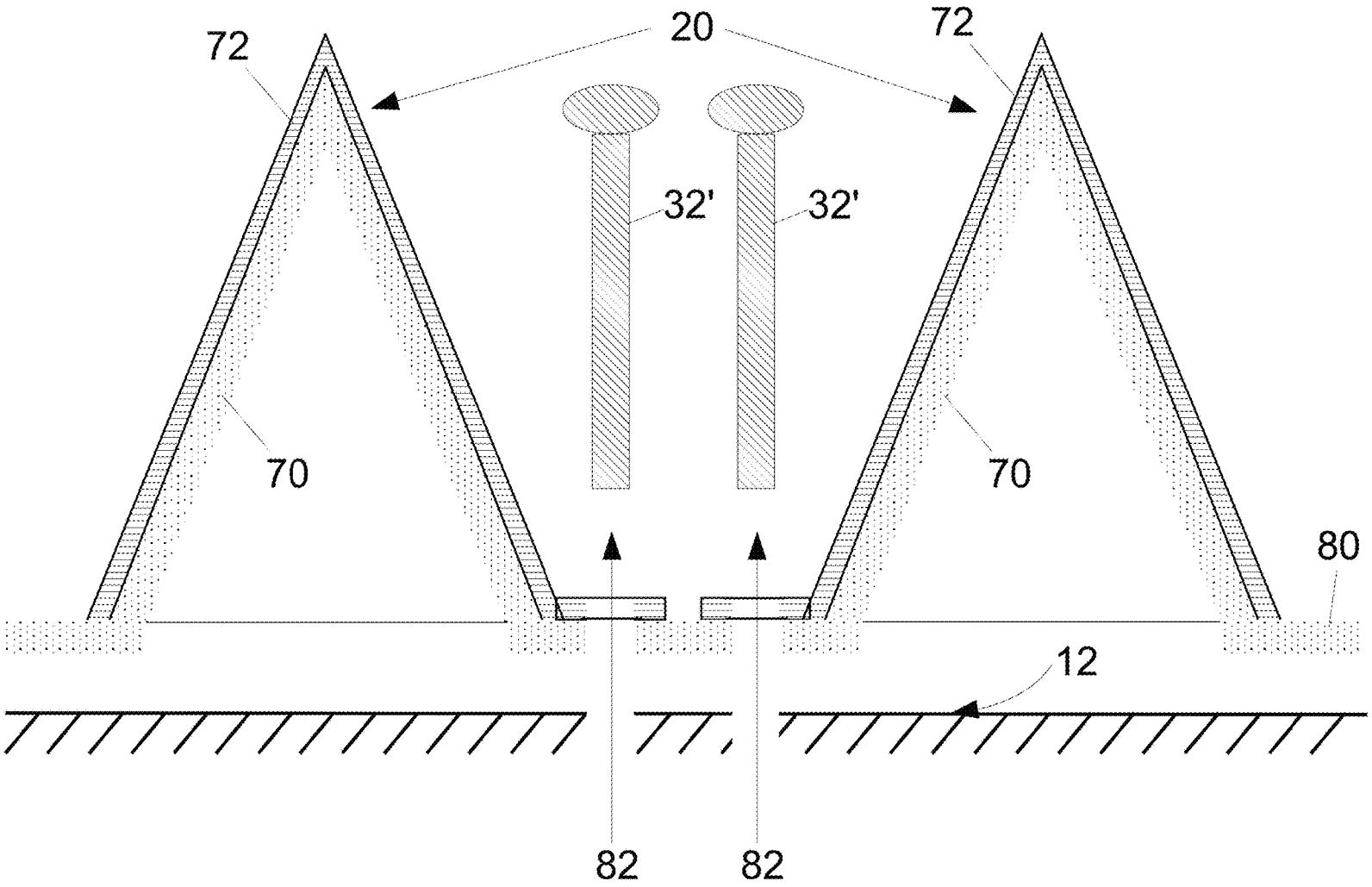
FIGS. 7-10 diagrammatically illustrate additional embodiments of the electrically conductive tapered projections.
Figure 8:
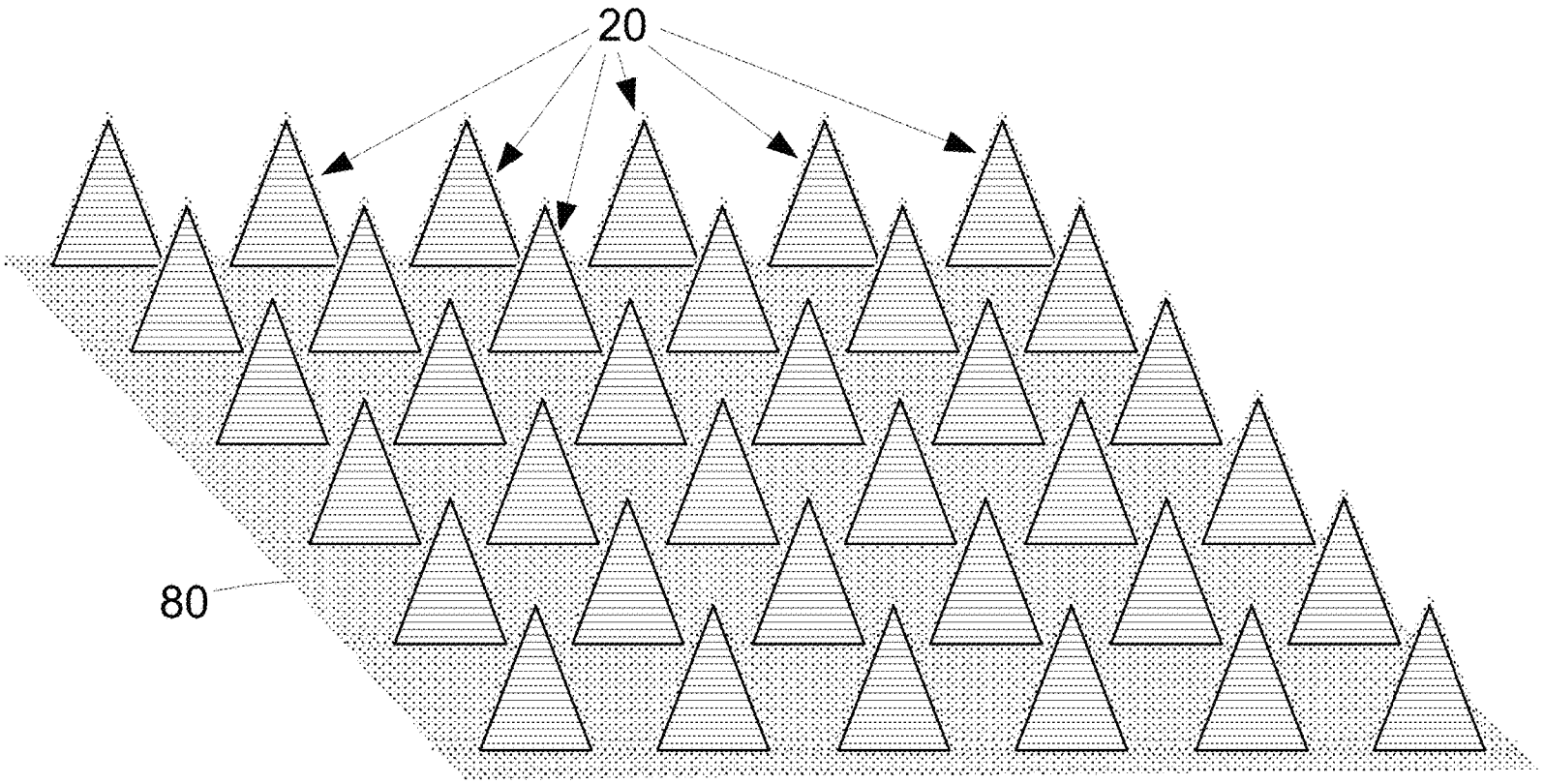

FIGS. 7 and 8 show an exploded side-sectional view and a perspective view, respectively, of an embodiment in which the dielectric tapered projections 70 are integrally included in a dielectric plate 80. The electrically conductive layer 72 coats each dielectric tapered projection 70 but has isolation gaps 82 that provide galvanic isolation between the neighboring dielectric tapered projections 20. The isolation gaps 82 can be formed after coating the electrically conductive layer 72 by, after the coating, etching the coating away from the plate 80 between the electrically conductive tapered projections 20 to galvanically isolate the electrically conductive tapered projections from one another. Alternatively, the isolation gaps 82 can be defined before the coating by, before the coating, depositing a mask material (not shown)

on the plate 80 between the electrically conductive tapered projections 20 so that the coating does not coat the plate in the isolation gaps 82 between the electrically conductive tapered projections whereby the electrically conductive tapered projections are galvanically isolated from one another. As seen in the perspective view of FIG. 8, the result is that the dielectric plate 80 covers (and therefore occludes) the surface of the i-PCB 10, with the electrically conductive tapered projections 20 extending away from the dielectric plate 80.

With particular reference to FIG. 7, in one approach for the electrical interconnection, through-holes 82 pass through the illustrative plate 80 and the underlying i-PCB 10, and rivets, screws, or other electrically conductive fasteners 32' pass through the through-holes 82 (note that FIG. 7 is an exploded view) and when thusly installed form the electrical feedthroughs 32' passing through the i-PCB 10. (Note, the perspective view of FIG. 8 is simplified, and does not depict the fasteners 32'). The use of the dielectric plate 80 with integral dielectric tapered projections 70 and the combined fastener/feedthroughs 32' advantageously allows the electrically conductive tapered projections 20 to be installed with precise positioning and without soldering.

In the embodiments of FIGS. 6-8, the electrically conductive coating 72 is disposed on the outer surfaces of the dielectric tapered projections 70. In this case, the dielectric tapered projections 70 may be either hollow or solid.

Figure 9:
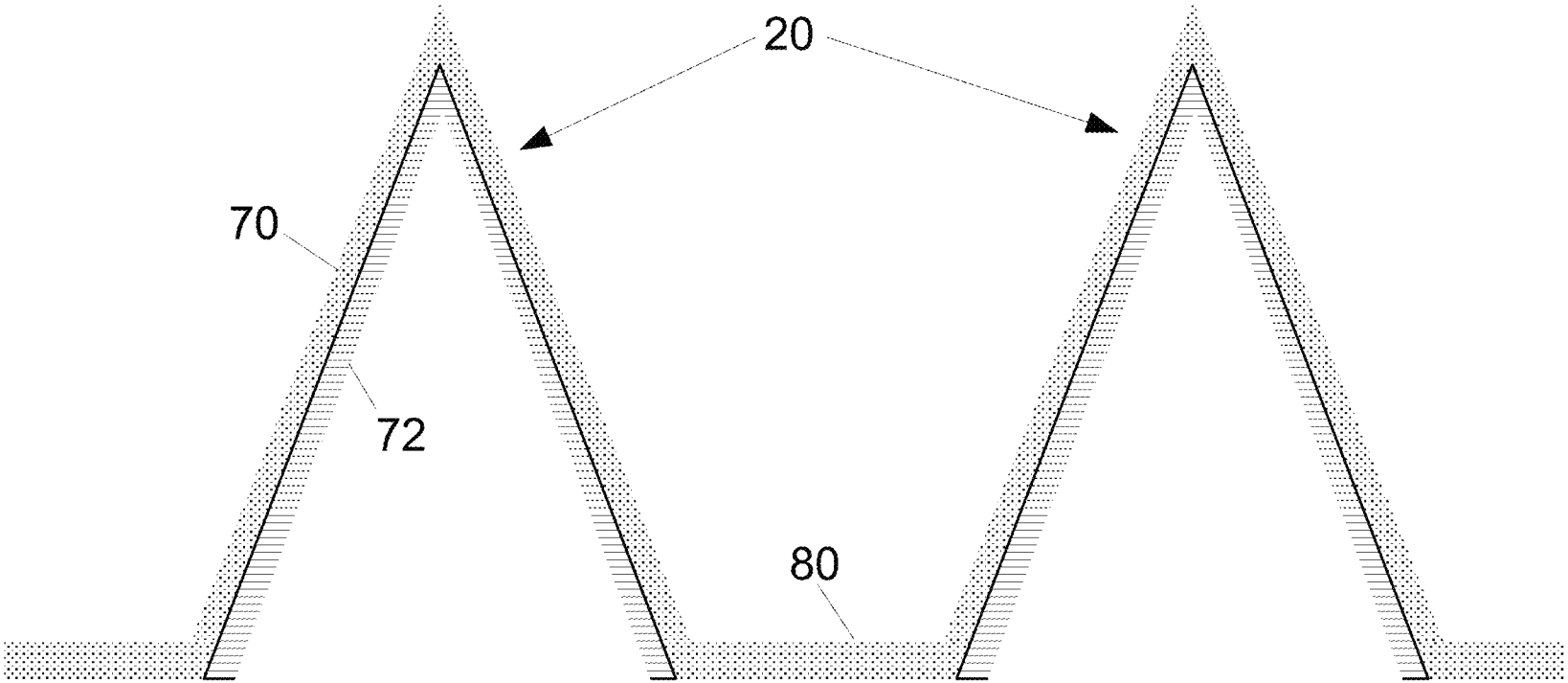
Figure 10:
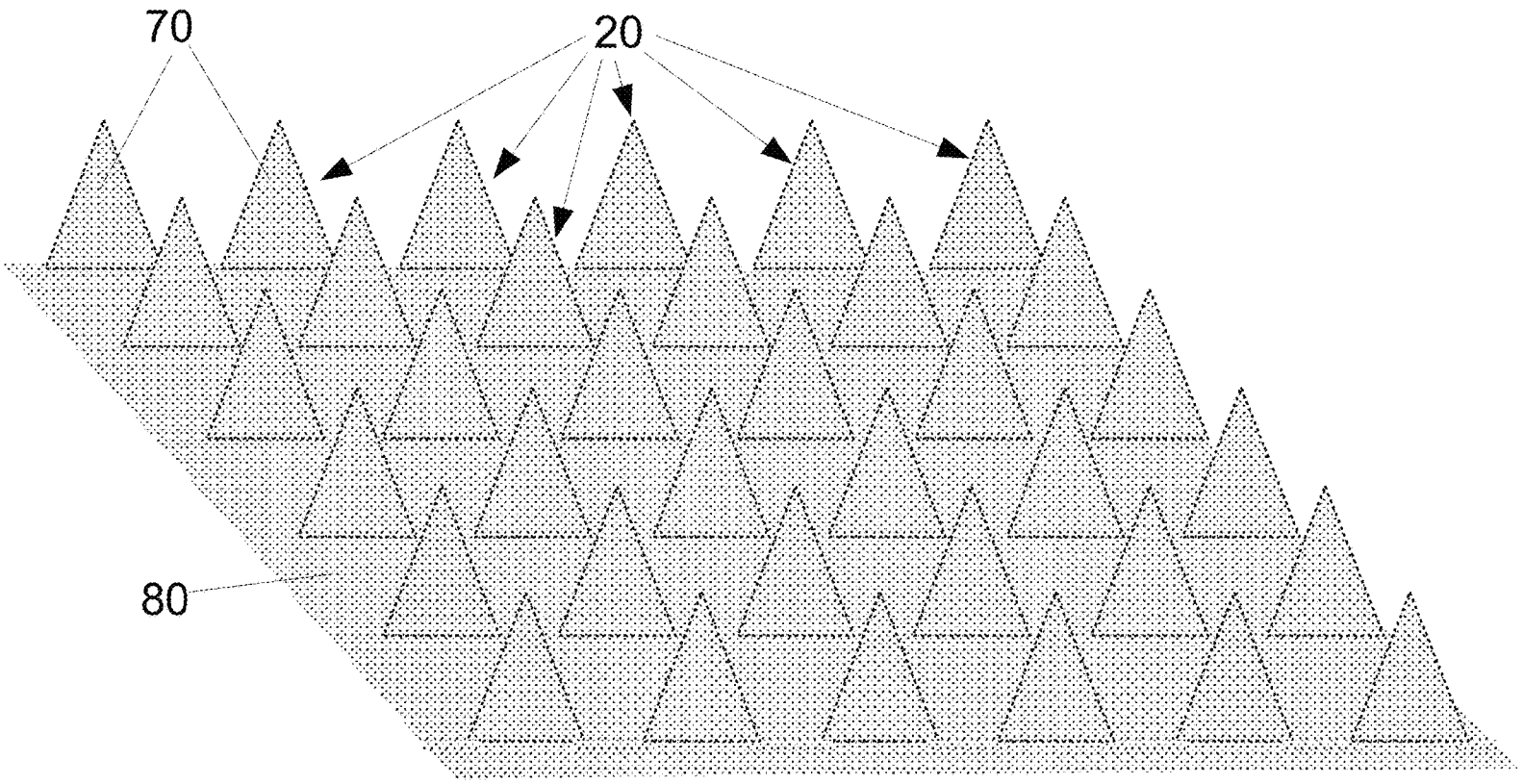

With reference to FIGS. 9 and 10, as the dielectric material is substantially transparent to the RF radiation, the electrically conductive coating 72 may instead be coated on inner surfaces of the (hollow) dielectric tapered projections 70. FIG. 9 shows a side sectional view of such an embodiment, while FIG. 10 shows a perspective view. The embodiment of FIGS. 9 and 10 again employs a dielectric plate 80 including the dielectric tapered projections 70. As seen in FIG. 10, by coating the electrically conductive coatings 72 on the inner surfaces of the hollow dielectric tapered projections 70, this results in the electrically conductive coating 72 being protected from contact from the outside by the dielectric plate 80 including the integral dielectric tapered projections 70. This can be useful in environments in which weathering may be a problem.

It is to be appreciated that the various disclosed aspects are illustrative examples, and that the disclosed features may be variously combined or omitted in specific embodiments. For example, one of the illustrative examples of the electrically conductive tapered projections 20 or a variant thereof may be employed without the QUAD subassembly circuitry configuration of FIGS. 2-5. Conversely the QUAD subassembly circuitry configuration of FIGS. 2-5 or a variant thereof may be employed without the dielectric/coating configuration for the electrically conductive tapered projections 20. Likewise, the chip baluns 30 may or may not be used in a specific embodiment; and/or so forth.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A radio frequency (RF) aperture comprising:

an interface printed circuit board having a front side and a back side;

an array of electrically conductive tapered projections having bases disposed on the front side of the interface printed circuit board and extending away from the front side of the interface printed circuit board;

baluns mounted on the back side of the interface printed circuit board wherein each balun has a balanced port electrically connected with two neighboring electrically conductive tapered projections of the array of electrically conductive tapered projections via electrical feedthroughs passing through the interface printed circuit board, each balun further having an unbalanced port; and RF circuitry disposed at the back side of the interface printed circuit board and electrically connected with the unbalanced ports of the baluns.

2. The RF aperture of claim 1 wherein the baluns comprise chip baluns and the RF circuitry comprises electronic components mounted on the back side of the interface printed circuit board.

3. The RF aperture of claim 1 further comprising:

a second printed circuit board disposed parallel with the interface printed circuit board and facing the back side of the interface printed circuit board;

wherein the RF circuitry comprises electronic components mounted on the second printed circuit board.

4. The RF aperture of claim 1 wherein the RF circuitry comprises RF power splitter/combiners connecting one or more combinations of the unbalanced ports of the baluns with one or more RF connectors.

5. The RF aperture of claim 4 wherein the RF power splitter/combiners are interconnected as a plurality of RF subassemblies wherein each RF subassembly connects a subset of four or more of the unbalanced ports of the baluns with a single RF connector.

6. The RF aperture of claim 4 wherein:

the RF circuitry further comprises a plurality of analog-to-digital (A/D) converters; and the RF power splitter/combiners are interconnected as a plurality of RF subassemblies wherein each RF subassembly connects a subset of four or more of the unbalanced ports of the baluns with a single analog-to-digital (A/D) converter.

7. The RF aperture of claim 1 wherein the RF circuitry comprises a signal conditioning circuit connected with each unbalanced port of the baluns wherein the signal conditioning circuit connected with each unbalanced port includes:

an RF transmit amplifier;

an RF receive amplifier; and

RF switching circuitry configured to switch between a transmit mode operatively connecting the RF transmit amplifier with the unbalanced port and a receive mode operatively connecting the RF receive amplifier with the unbalanced port.

8. The RF aperture of claim 1 wherein the RF circuitry includes beam steering circuitry configured to operate the RF aperture as a phased array directional RF transmitter and/or a phased array directional RF receiver.

9. The RF aperture of claim 1 wherein the array of electrically conductive tapered projections comprise:

dielectric tapered projections; and an electrically conductive layer disposed on a surface of the dielectric tapered projections.

10. The RF aperture of claim 9 comprising a dielectric plate including the dielectric tapered projections.

11. The RF aperture of claim 9 wherein the dielectric tapered projections are hollow, and the electrically conductive layer is disposed on an outer surface or an inner surface of the hollow dielectric tapered projections.

12. A radio frequency (RF) aperture comprising:

an interface printed circuit board having a front side and a back side;

an array of electrically conductive tapered projections having bases disposed on the front side of the interface printed circuit board and extending away from the front side of the interface printed circuit board, wherein the electrically conductive tapered projections comprise dielectric tapered projections and an electrically conductive layer disposed on a surface of the dielectric tapered projections; and RF circuitry disposed at the back side of the interface printed circuit board and electrically connected with the array of electrically conductive tapered projections via electrical feedthroughs passing through the interface printed circuit board.

13. The RF aperture of claim 12 comprising a dielectric plate including the dielectric tapered projections, the electrically conductive layer not coating portions of the plate between the dielectric tapered projections such that the dielectric tapered projections are galvanically isolated from one other.

14. The RF aperture of claim 12 wherein the dielectric tapered projections are hollow.

15. The RF aperture of claim 12 wherein the RF circuitry comprises electronic components mounted on the back side of the interface printed circuit board.

16. The RF aperture of claim 12 further comprising:

a second printed circuit board disposed parallel with the interface printed circuit board and facing the back side of the interface printed circuit board;

wherein the RF circuitry comprises electronic components mounted on the second printed circuit board.

17. The RF aperture of claim 12 wherein the RF circuitry includes:

baluns with balanced ports connecting pairs of electrically conductive tapered projections that are adjacent in the array of electrically conductive tapered projections via the electrical feedthroughs passing through the interface printed circuit board.

18. The RF aperture of claim 17 wherein the RF circuitry further includes first level RF power splitter/combiners each connecting the unbalanced ports of two baluns.

19. The RF aperture of claim 18 wherein the RF circuitry further includes second level RF power splitter/combiners each connecting two first level RF power splitter/combiners.

20. The RF aperture of claim 17 wherein the RF circuitry further includes a signal conditioning circuit connected with an unbalanced port of each balun and including:

an RF transmit amplifier;

an RF receive amplifier; and

RF switching circuitry configured to switch between a transmit mode operatively connecting the RF transmit amplifier with the unbalanced port and a receive mode operatively connecting the RF receive amplifier with the unbalanced port.

21. The RF aperture of claim 12 wherein the RF circuitry includes beam steering circuitry configured to operate the RF aperture as a phased array directional RF transmitter and/or a phased array directional RF receiver.

* * * * *